United States Patent [19]

Wildi et al.

[11] Patent Number: 4,935,785

[45] Date of Patent: Jun. 19, 1990

[54] ELECTROPHOTOGRAPHIC FUSER ROLL AND FUSING PROCESS

[75] Inventors: Eva A. Wildi; Ian D. Morrison, both of Webster, N.Y.

[73] Assignee: Xerox Corporation, Stamford, Conn.

[21] Appl. No.: 280,069

[22] Filed: Dec. 5, 1988

[51] Int. Cl.[5] ..... G03G 15/20

[52] U.S. Cl. ..... 355/290; 355/285; 427/13; 427/39; 427/14.1; 430/33; 430/48; 430/124

[58] Field of Search ..... 355/290, 282, 285; 430/31, 33, 48, 24; 427/13, 14, 35, 39, 45; 219/216

[56] References Cited

U.S. PATENT DOCUMENTS

| | | | |
|---|---|---|---|
| 3,740,249 | 10/1971 | Takiguchi | 117/21 |
| 3,893,800 | 7/1975 | Wako | 432/60 |
| 4,320,714 | 3/1982 | Shimazaki et al. | 118/60 |
| 4,470,688 | 9/1984 | Inagaki et al. | 355/290 X |
| 4,596,920 | 6/1986 | Inagaki | 355/290 X |
| 4,616,917 | 10/1986 | Sakurai | 355/290 X |
| 4,763,158 | 8/1988 | Schlueter, Jr. | 355/290 X |

OTHER PUBLICATIONS

"Charge Trapping in Plasma-Polymerized Thin Films", J. E. Klemberg-Sapieha et al., Dept. of Engineering Physics, Ecole Polytechnique, App. Phys. Lett., vol. 37, No. 1, Jul. 1, 1980, pp. 104–105.

*Primary Examiner*—A. C. Prescott
*Attorney, Agent, or Firm*—Judith L. Byorick

[57] ABSTRACT

Disclosed is a process for fusing an electrophotographic image to a substrate which comprises developing an electrostatic latent image with a toner of one polarity and contacting the developed image with a fuser roll having on the surface thereof an insulating material charged to the same polarity as the toner. In one embodiment of the invention, the surface of the fuser roll comprises an insulating material and the charge is applied with a charging means such as a corotron. In another embodiment of the invention, the surface of the fuser roll comprises a polymeric electret material having embedded therein stable electrical charges of the same polarity as that of the toner. For this second embodiment, the fuser roll may optionally be charged with a charging means. Additionally, the fuser roll may comprise a core of a resistive material that increases in temperature when the charging means is activated, which may reduce the amount of energy needed to heat the fuser roll, or may eliminate the need for other means of heating the fuser roll.

25 Claims, 4 Drawing Sheets

ELECTROPHOTOGRAPHIC FUSER ROLL AND FUSING PROCESS

BACKGROUND OF THE INVENTION

The present invention is directed to a process for fusing images generated by electrophotographic methods, developed, and transferred to a substrate. More specifically, the present invention is directed to a process for fusing electrophotographic images which comprises applying heat and/or pressure to a transferred image with a fuser roll having a surface of an insulating material to which has been applied a charge of the same polarity of the toner particles with which the image was developed, thereby assisting in the release of toner from the fuser roll and reducing or eliminating offset without the need for use of materials such as release oils. Offset occurs when, during the fusing process, toner adheres to the fuser roll, which impairs image quality. In one embodiment of the present invention, the fuser roll is charged to the same polarity as the toner by means of a corotron, which results in the fuser roll repelling the toner particles. In another embodiment of the invention, the fuser roll surface comprises a polymeric material having embedded therein charges of the same polarity as that of the toner. In yet another embodiment of the invention, the fuser roll comprises a resistive material, which enables generation of both heat and surface charge upon application of voltage to the surface of the fuser roll.

Fusing processes for electrophotographic images are known. For example, U.S. Pat. No. 3,740,249 discloses a solvent fixing process which comprises contacting a film of a solvent formed on the surface of a grounded conductive roller with the toned images. A corona discharge of polarity opposite to that of the toner is applied to the back of the paper, which draws the toner away from the fuser roll, and the nonconductive, nonpolar solvent fixes the toner image to the paper. The corona discharge brings the sheet into close contact with the roller to provide uniform fixing and also attracts the toner to the paper, which reduces offset onto the roller and reduces disturbance of the image by the solvent. Alternatively, instead of charging the paper by corona discharge, the paper may be passed through two rollers, one of which is biased to a polarity opposite to that of the toner.

In addition, U.S. Pat. No. 4,320,714 discloses a heat fixing device, wherein an electroconductive layer is provided in the surface of one of the fixing and pressure rolls to prevent chage buildup on the roll surface. Preferably, the layer is aluminum plated and covered with a nonadhesive layer such as tetrafluoroethylene, or HTV or RTV silicone rubber. The fuser roll prevents an electric field from forming and extending through an imaged sheet to be fixed, and eliminates offset on the roll. The pressure roller contains a thin grounded metal layer as near to the outside edge of the roll as possible, and a grounded electrode reverses the direction of the electrostatic field caused by spurious charge buildup on the roll.

Further, U.S. Pat. No. 3,893,800 discloses an apparatus for fusing electrophotographic images wherein a contact fuser softens the powder images by means of heat conducted through the back of the substrate. Heat is applied to the back side of the substrate by a heated roll to which is electrostatically tacked the substrate in order to improve heat transfer thereto. Trail-end flip up of the substrate is prevented by producing an attractive force between the substrate and the means for guiding the substrate to the heated roll after the substrate has been tacked to the heated roll.

Although known processes for fusing electrophotographic images are suiable for their intended purposes, a need continues to exist for fusing processes that reduce or eliminate offset without the need for release oils, since release oils constitute an added expense, lead to problems caused by the presence of fuser oil on fused copies, may interact unfavorably with photoreceptor materials, and lead to customer inconvenience. A need also exists for fusing processes that enable fusing of electrophotographic images without the need for release oils and that enable formation of high quality images.

SUMMARY OF THE INVENTION

It is an object of the present invention to provide a process for fusing electrophotographic images.

It is another object of the present invention to provide a process for fusing electrophotographic images without the need for release oils.

It is yet another object of the present invention to provide a process for fusing electrophotographic images that enables generation of high quality images.

It is still another object of the present invention to provide a process for fusing electrophotographic images with a fuser roll having a surface of an electret material.

Another object of the present invention is to provide a process for fusing electrophotographic images wherein the fuser roll is charged to the same polarity as that of the toner by means of corona discharge.

Yet another object of the present invention is to provide a process for fusing electrophotographic images wherein the fuser roll comprises a resistive material.

These and other objects are achieved by providing a process for fusing an electrophotographic image to a substrate which comprises developing an electrostatic latent image with a toner of one polarity and contacting the developed image with a fuser roll having on the surface thereof an insulating material charged to the same polarity as the toner.

DETAILED DESCRIPTION OF THE INVENTION

Figure 1:
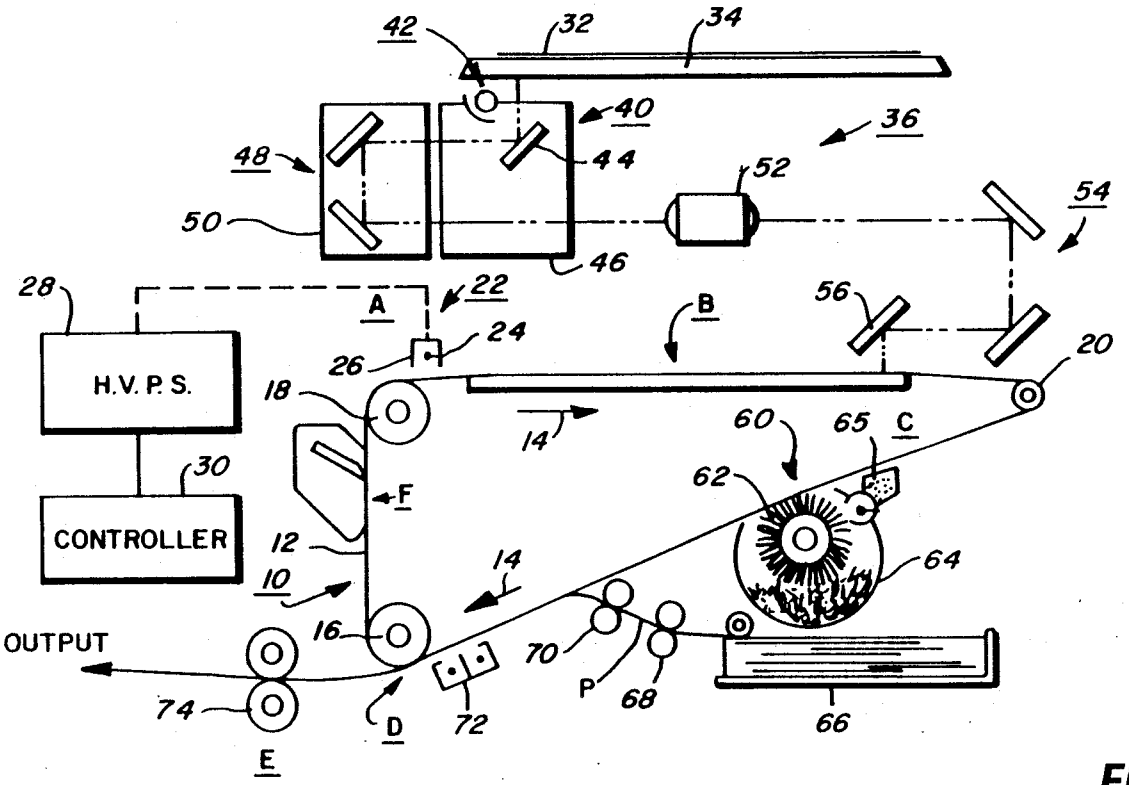
FIG. 1 illustrates an embodiment of the fuser roll and fusing process of the present invention in a xerographic reproduction machine.

Referring now to the drawings, wherein the showings are for the purpose of illustrating a preferred embodiment of the invention and not for the purpose of limiting same, FIG. 1 schematically depicts the various components of an illustrative electrophotographic device contemplated to incorporate the present invention therein.

As shown in FIG. 1, the electrophotographic device employs a belt 10 having a photoconductive surface 12 deposited on a conductive substrate. Belt 10 moves in the direction of arrow 14 to advance successive portions of photoconductive surface 12 sequentially through the various processing stations disposed about the path of movement thereof. Belt 10 is entrained around drive roller 16 and tension rollers 18 and 20. Drive roller 16 is mounted rotatably in engagement with belt 10 and driven by suitable means such as a conventional motor (not shown).

Initially, a portion of belt 10 passes through charging station A. At charging station A, a corona generating device 22 charges photoconductive surface 12 of the belt 10 to a relatively high, substantially uniform potential. The corona generating device comprises charging electrode 24 and conductive shield 26. A high voltage power supply 28 controlled by controller 30 is connected to the charging electrode 24 to provide a high charging voltage and control the charge placed on the surface 12. Controller 30 is preferably a known programmable controller or combination of controllers, which conventionally controls all of the other machine steps and functions described herein and including the operation of document feeders, the paper path drives, and other machine operations. Controller 30 also conventionally provides for storage and comparisons of counted values including copy sheets and documents, and numbers of desired copies, and control of operations selected by an operator.

Next, the charged portion of photoconductive surface 12 is advanced through exposure station B. At exposure station B, an original document 32 is positioned face down upon transparent platen 34. Optics assembly 36 contains optical components which incrementally scan and illuminate original document 32 and project a reflected image on surface 12 of belt 10. Shown schematically, these optical components comprise an illumination scan assembly 40, comprising illumination lamp and reflector 42, and full rate scan mirror 44 mounted on scan carriage 46. The carriage is supported for reciprocating movement in accordance with copying requirements along rails (not shown) extending parallel and below the length of the platen 34. Light reflected from the image is reflected by full rate scan mirror 44 to corner mirror assembly 48 on half rate scan carriage 50, which follows full rate carriage 44 at half the speed of the full rate carriage. The reflected light image from corner mirror assembly 48 is directed through lens 52, to a second corner mirror arrangement 54, and projected therefrom onto the charged portion of photoconductive surface 12 by mirror 56 to dissipate selectively the charge on the photoconductive surface, thereby recording an electrostatic latent image on photoconductive surface 12 which corresponds to the information areas contained within original document 32. It will, of course, be appreciated that a similar function is accomplished by an electronic printer employing a laser to dissipate selectively charge from a photoconductive surface.

Thereafter, belt 10 advances the electrostatic latent image recorded on photoconductive surface 12 to development station C. At development station C, a magnetic brush development system 60, including a magnetic brush developer roller 62 within housing 64 advances a developer mix of toner particles and carrier granules into contact with the electrostatic latent image. The latent image attracts the toner particles from the carrier granules forming a toner powder image on photoconductive surface 12 of belt 10. Additional toner is stored for use upon demand in toner particle dispenser 65.

Belt 10 then advances the toner powder image on surface 12 to transfer station D. A substrate, which may include paper sheets, transparencies, computer fan fold stacks, rolls of paper stock, etc., and hereinafter referred to as a sheet P is advanced toward transfer station D by a pair of feed roll pairs 68 and 70 in a timed sequence by a suitable conventional feeding arrangement so that the toner powder image developed on the photoconductor surface synchronously contacts the advancing sheet P at transfer station D.

Transfer station D includes a corona generating device 72 which sprays ions onto the back side of sheet P passing through the station. The toner powder image from the photoconductive surface 12 is thereby attracted to the sheet, and a normal force is provided which causes photoconductive surface 12 to take over transport of the advancing sheet P. After transfer, the sheet continues to move advancing to fusing station E.

Figure 2:
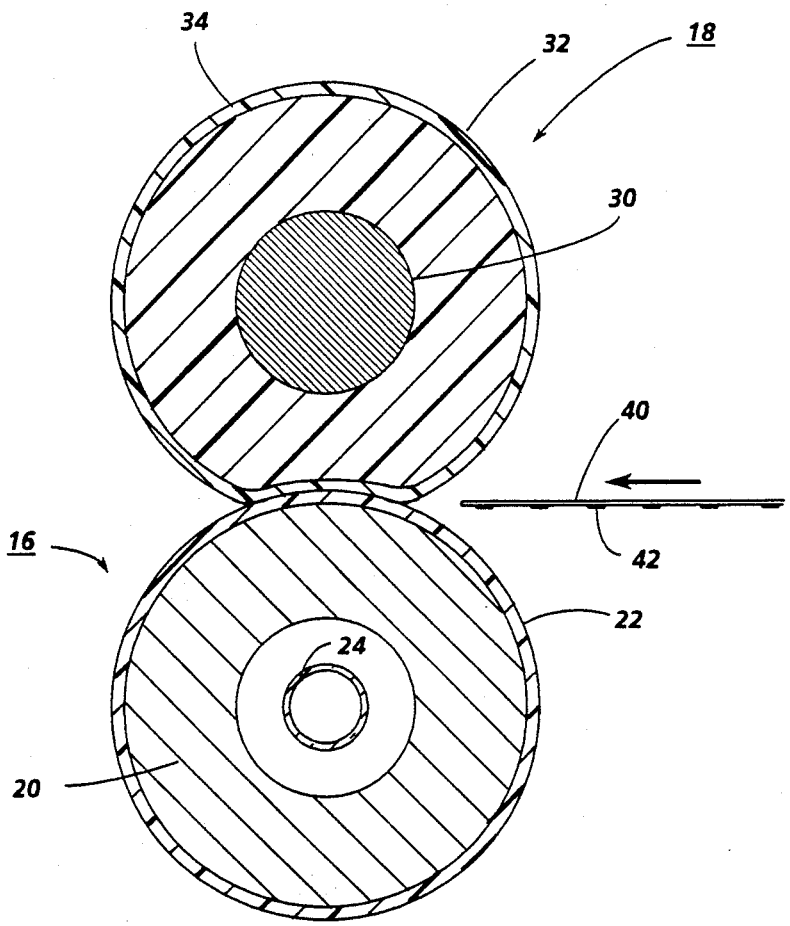
FIG. 2 illustrates one embodiment of the fuser roll and fusing process of the present invention.

Fusing station E includes a fuser assembly, indicated generally by the reference number 74 and shown in more detail in FIG. 2, where a sheet is stripped from the photoreceptor surface and passed through a heated nip roll pair whereby the toner powder image is permanently affixed to the sheet. After fusing, the advancing sheet is directed to an output for removal from the printing machine by the operator. Alternatively, the sheets may be directed to a finishing module where further paper handling functions, such as stapling, stacking,.collating, etc., are available.

After the sheet support material is separated from the photoconductive surface 12 of belt 10, some residual particles remain adhering to the surface. These residual particles are removed from photoconductive surface 12 at cleaning station F.

The fuser roller employed for the process of the present invention comprises a material that exhibits insulative properties and is thus capable of retaining an electric charge applied to its surface. The roller may be formulated entirely of the insulating material, or may comprise a core of a material such as copper, aluminum, steel, or other suitable materials coated with the insulating material. In addition, a conventional fuser roll may be employed as the core and the insulating charged material may be coated on its surface, thereby maintaining any desirable mechanical and thermal properties of the conventional fuser roll and also reducing or eliminating offset according to the present invention. When the roller surface is charged by means such as a corotron, the insulating material need not possess perfect insulating characteristics; it is sufficient for the material to retain the applied charge until recharging can occur. Suitable insulating materials for the fuser roll include those conventionally used for fuser rolls, such as tetrafluoroethylene, HTV (high temperature vulcanization-type) silicone rubber, RTV (room temperature vulcanization-type) silicone rubber, fluroinated polymers such as polytetrafluoroethylene, including Teflon®, available from E. I. DuPont de Nemours and Co., Wilmington, DE, fluorocarbon elastomers, including the vinylidene fluoride-based fluoroelastomers which contain hexafluoropropylene as a comonomer, available as Viton from E. I. DuPont de Nemours and Co., and other insulating polymers such as a saturated hydrocarbon, including poly(isobutylene), poly(ethylene) and poly(propylene), polystyrene, polybutadiene, polynorbornadiene, a poly(arylene), such as poly(p-xylylene), a poly(ethylene terphthalate), a poly(ether ether ketone), a poly(carbonate), a poly(carbonate-co-ester), a poly(-sulfone), a poly(arylate), a poly(etherimide), a poly(arylsulfone), a poly(ethersulfone), and a poly(amide-imide). Conventional fuse rollers suitable for the process of the present invention are described in several publications, such as U.S. Pat. Nos. 3,256,002; 3,268,351; 3,841,827; 3,912,901; 4,149,797; 4,078,286; 4,372,246 and 4,196,256, the disclosures of each of which are totally incorporated herein by reference. The process of the present invention is suitable for heat fusing, cold pressure fusing, and hot pressure fusing processes.

FIG. 2 illustrates a typical fusing apparatus. The heated pressure fusing apparatus includes a fuser roll 16, which may or may not be heated, and a backup or pressure roll 18. The fuser roll in this illustrative embodiment is a hollow circular cylinder including a metallic core 20 which is covered with a layer 22 made of an insulating material such as a silicone rubber. In one embodiment of the present invention, layer 22 comprises a polymer electret material as further described herein. An optional heating means such as a quartz lamp 24 located inside the fuser roll is a source of thermal energy for the fusing apparatus. Power to the lamp is controlled by a thermal sensor (not shown), which contacts the periphery of the fuser roll as described, for example, in U.S. Pat. No. 3,357,249. The pressure or backup roll 18 in this illustrative embodiment is also a circular cylinder and comprises a metal core 30 surrounded by a thick organic rubber layer 32 and then by another layer 34 made of Teflon or other suitable material. When the two rollers 16 and 18 are engaged as shown in FIG. 2, the applied load deforms the rubber in the pressure roll to provide the nip with a finite width. A copy sheet 40 electrostatically bearing the toner images 42 on the underside is brought into contact with the nip of the rolls and with the toner images contacting the fuser roll surface. The mechanism for driving the rolls and for lowering and raising rolls into contact can be accomplished by any suitable means such as that described, for example, in U.S. Pat. No. 3,291,466, or any suitable mechanical camming device. As a sheet of material is advanced between the rolls 16 and 18, the toner images on a support material are contacted by the peripheral surface of roll 16, causing the toner images to become tackified, which would tend to cause the toner to offset onto the roll except that it is prevented from doing so by the coating on the roll.

The surface of the fuser roll is charged by any suitable means. For example, when a polymeric material is present on the surface, a polymer electret, which is a polymer having stable electric charges embedded therein, may be formed by adding the charge chemically to the polymer by a plasma graft process. This process entails placing the polymer in a vacuum chamber, introducing into the chamber a fluorinated gas such as one or more fluorinated hydrocarbon gases, sulfur hexafluoride, or fluorine gas in an inert carrier gas such as helium or argon, and applying an rf field, typically of 10 to 100 watts, to form a plasma within the chamber generally for from about 10 seconds to abut 10 minutes, thereby generating ions and free radicals that react with the polymer to result in a polymer electret having electric charges stably embedded therein. Further information regarding plasma techniques may be found in *Plasma Science and Technology* by Herman V. Boenig, Cornell University Press, Ithaca (1982), and in *Techniques and Applications of Plasma Chemistry* by John R. Hollahan and Alexis T. Bell, John Wiley & Sons, New York (1974), the disclosures of each of which are totally incorporated herein by reference. An example of such a reaction is the treatment of the surface of a polymer such as silicone rubber with a plasma formed from exposing sulfurhexafluoride to rf power in a vacuum chamber. This process results in a fuser roll having either a positively charged or negatively charged surface, depending upon the direction of the imposed bias of the electric field, which roll will repel toner particles of the same polarity, thereby reducing or eliminating offset onto the fuser roll. Polymeric materials suitable for becoming chemically charged include tetrafluoroethylene, HTV (high temperature vulcanization-type) silicone rubber, RTV (room temperature vulcanization-type) silicone rubber, fluorinated polymers such as polytetrafluoroethylene, including Teflon®, available from E. I. DuPont de Nemours and Co., Wilmington, DE, fluorocarbon elastomers, including the vinylidene fluroide-based fluoroelastomers which contain hexafluoropropylene as a comonomer, available as Viton® from E. I. DuPont de Nemours and Co., and other insulating polymers, such as a saturated hydrocarbon, including poly(isobutylene), poly(ethylene) and poly(-propylene), polystyrene, polybutadiene, polynorbornadiene, a poly(arylene), such as poly(p-xylylene), a poly(ethylene terphthalate), a poly(ether ether ketone), a poly(carbonate), a poly(carbonate-co-ester), poly(sulfone), a poly(arylate), a poly(etherimide), poly(arylsulfone), a poly(ethersulfone), and a poly(amide-imide). Further information regarding the formation of polymer electrets may be found in J. E. Klemberg-Sapieha, S. Sapieha, M. R. Wertheimer, and A. Yelon, "Charge Trapping in Plasma-Polymerized Thin Films," *Appl. Phys. Lett.*, Vol. 37, No. 1, pages 104–105 (1980), the disclosure of which is totally incorporated herein by reference.

Figure 3:
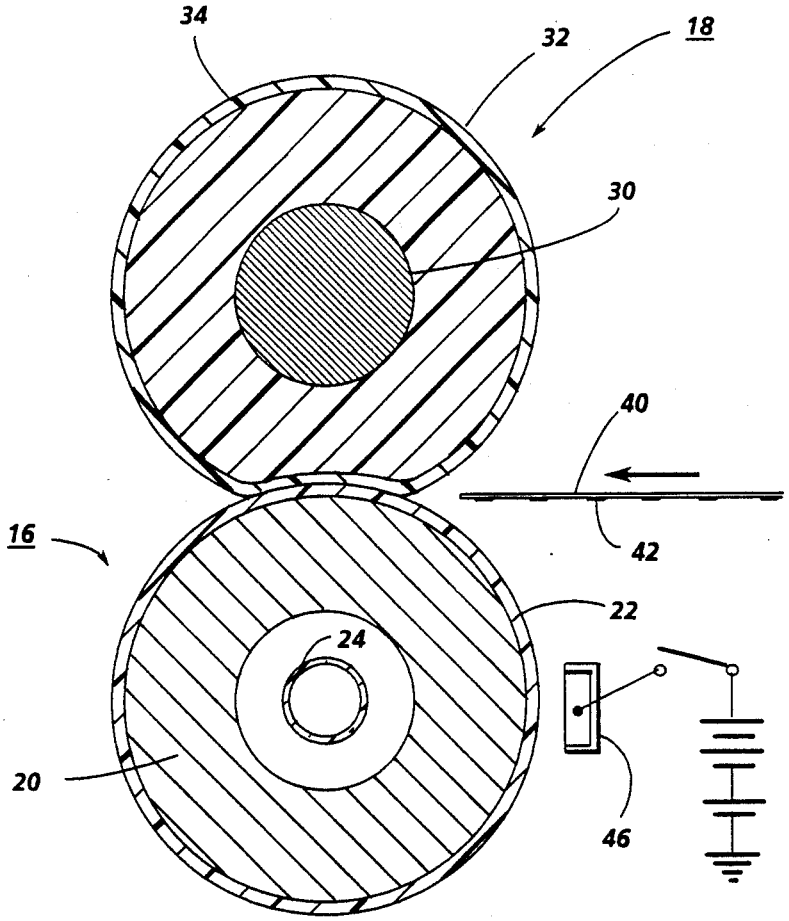
FIG. 3 illustrates another embodiment of the fuser roll and fusing process of the present invention wherein the surface of the fuser roll is periodically recharged by a charging means.

When the fuser roll prepared by chemically adding charge to a polymeric surface exhibits a relatively permanent charge, that is, a charge that will last for the lifetime of the fuser roll, additional charging of the roll may not be necessary. When, however, a fuser roll with chemically added surface charge exhibits a decrease in charge over time, the surface may be recharged periodically by means such as those typically employed for charging photoreceptor surfaces, such as a wire corotron, a dicorotron, a scorotron, or a pin corotron. In addition, a fuser roll that initially exhibits no surface charge may be charged to the desired polarity by a charging means. In one embodiment, as illustrated in FIG. 3, the fuser roll is recharged after each image bearing substrate has been fused. Fuser roll 16 in this illustrative embodiment is a hollow circular cylinder including a metallic core 20 which is covered with a layer 22 made of an insulating material such as polytetrafluoroethylene. An optional heating means such as a quartz lamp 24 located inside the fuser roll is a source of thermal energy for the fusing apparatus. The pressure or backup roll 18 in this illustrative embodiment is also a circular cylinder and comprises a metal core 30 surrounded by a thick organic rubber layer 32 and then by another layer 34 made of polytetrafluoroethylene or other suitable material. A charging means 46, such as a corotron, is energized, thereby charging the insulating surface of fuser roll 16 prior to contact with an image bearing substrate or copy sheet. A copy sheet 40 electrostatically bearing the toner images 42 on the underside is then brought into contact with the nip of the rolls and with the toner images contacting the fuser roll surface. As a sheet of material is advanced between the rolls 16 and 18, the toner images on the support material are contacted by the charged peripheral surface of the roll 16 causing the toner images to become tackified. Subsequent to contact of the toner image by the fuser roll 16, charging means 46 is again energized, thereby recharging the insulating surface of fuser roll 16 prior to contact with a subsequent copy sheet.

The voltage applied with the corotron is of a magnitude sufficient to repel toner particles from the surface of the fuser roll, but is not so high that the unfused image is disturbed by the repulsive field, thereby resulting in reduced image quality or destruction of the image. The upper and lower limits of the voltage magnitude is dependent upon the toner material with which the image is developed and upon the curvature and size of the fuser roll, and must be determined empirically or experimentally for each toner and fuser roll employed. Generally, however, the voltage magnitude will be in the range typically employed in developer housings, which is typically from about 50 to about 500 volts, although the voltage may be outside of this range provided that the objectives of the present invention are achieved.

In a particular embodiment of the present invention, the fuser roll comprises a resistive material, such as a polymeric material loaded with conductive particles. A material of this type comprises conductive particles, such as carbon or metallic particles, contained within a polymeric matrix. The purpose of the conductive particles is to provide an electrical path for electric charges applied to the surface to discharge slowly to ground potential. The slow electrical discharge provides a means by which a substantial electric charge can be maintained at the surface to repel similarly charged toner particles but yet relax to a low level before being regenerated on the next photocopying cycle. Such a slow electric discharge also generates heat, which aid in the function of the fuser roll. Such materials are prepared by adding the conductive particles to the monomer solution prior to polymerization and subsequently polymerizing the monomers, or by mixing the conductive particles with the polymer either neat or in a solvent and applying the dispersion to a supporting roller, which results in formation of a polymer matrix around the particles. Typically, the conductive particles are present in an amount of from about 10 to about 20 percent, although this amount may vary from this range, provided that the resulting material is resistive and suitable for the purposes of the present invention. Suitable conductive particles include carbon black, tin oxides, zinc oxides, iron, lead and other metals and their oxides, copper, its oxides and its salts, particularly copper iodide. Suitable polymeric materials include tetrafluoroethylene, HTV (high temperature vulcanization-type) silicone rubber, RTV (room temperature vulcanization-type) silicone rubber, fluorinated polymers such as polytetrafluoroethylene, including Teflon®, available from E. I. DuPont de Nemours and Co., Wilmington, DE, fluorocarbon elastomers, including the vinylidene fluoride-based fluoroelastomers which contain hexafluoropropylene as a comonomer, available as Viton® from E. I. DuPont de Nemours and Co., and other insulating polymers, such as a saturated hydrocarbon, including poly(isobutylene), poly(ethylene) and poly(propylene), polystyrene, polybutadiene, polynorbornadiene, a poly(arylene), such as poly(p-xylylene), a poly(ethylene terphthalate), a poly(ether ether ketone), a poly(carbonate), a poly(carbonate-co-ester), poly(sulfone), a poly(arylate), a poly(etherimide), a poly(arylsulfone), a poly(ethersulfone), and poly(amide-imide), and any other polymeric materials from which fuser rolls have been made. The resistive material generally is situated in the core of the fuser roll. For example, in FIG. 2, substituting metallic core 20 with the resistive material results in this embodiment of the invention. Upon application of voltage to the surface of the fuser roll of a resistive material, the current passes through the resistive material in the roll and generates heat, enabling the fuser roll to increase from room temperature to from about 325° F. to about 450° F. Thus, in a heat or heat and pressure fusing process, forming the fuser roll of a resistive material enables heating of the roll, thereby reducing the amount of energy required to heat the roll by other means, such as a central heating core or quartz lamp, or eliminating the need for other heating means.

Figure 4:
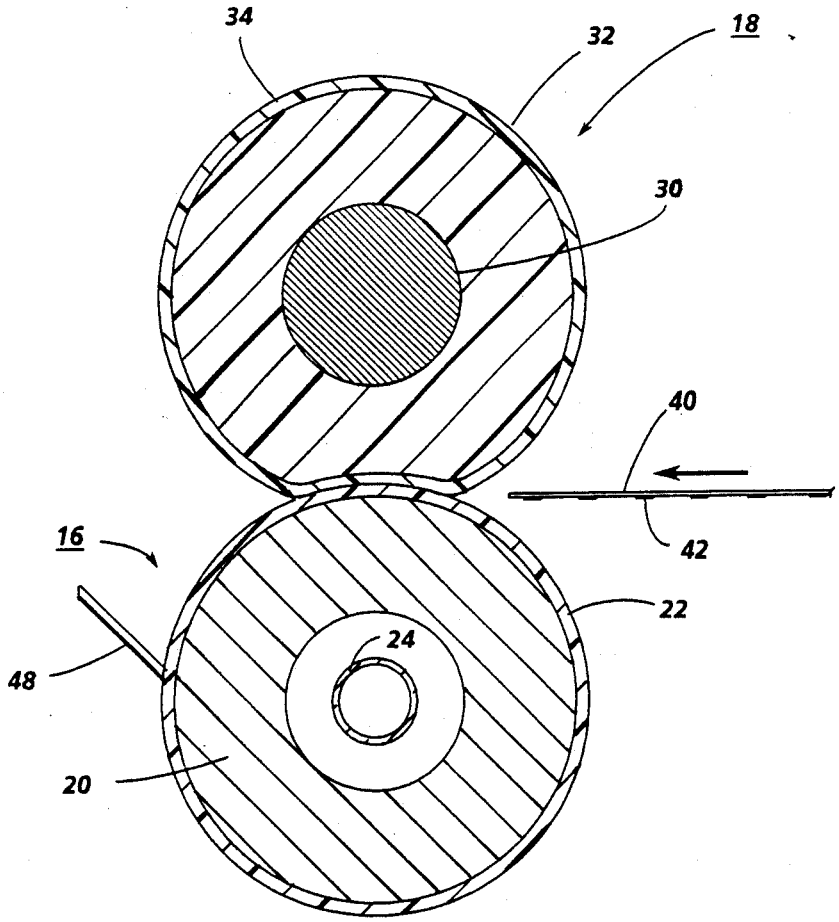
FIG. 4 illustrates still another embodiment of the fuser roll and fusing process of the present invention wherein the surface of the fuser roll is continually cleaned by a cleaning means.

In another embodiment of the present invention, the fuser roller is cleaned either periodically or continuously to remove particles or other debris attracted to the charged surface of the fuser roll. These particles, if not removed, could neutralize some or all of the charge on the roll surface and could also contaminate the fused images. For example, shown in FIG. 4 is a fuser roll of the present invention wherein the roll is continuously cleaned by a cleaning blade. Fuser roll 16 in this illustrative embodiment is a hollow circular cylinder including a metallic core 20 which is covered with a layer 22 made of a charged insulating material such as a silicone rubber. The pressure or backup roll 18 in this illustrative embodiment is also a circular cylinder and comprises a metal core 30 surrounded by a thick organic rubber layer 32 and then by another layer 34 made of polytetrafluoroethylene or other suitable material. A copy sheet 40 electrostatically bearing the toner images 42 on the underside is brought into contact with the nip of the rolls and with the toner images contacting the fuser roll surface. As a sheet of material is advanced between the rolls 16 and 18, the toner images on the support material are contacted by the charged peripheral surface of the roll 16 causing the toner images to become tackified. Subsequent to contact of the toner image by the fuser roll 16, a cleaning means 48, which in this illustrative embodiment is a cleaning blade, contacts the surface of fuser roll 16, thereby cleaning the surface of the roll prior to contact with a subsequent copy sheet. Contact between the cleaning means 48 and the fuser roll 16 may be either continuous or periodic. Other cleaning means may also be employed, such as fiber brushes, a wiper cloth, or a counter rotating foam roll.

Although not necessary to achieve the objects of the present invention, the method of enhancing toner release from a fuser roll disclosed herein may, if desired, be used in conjunction with other methods of reducing offset, including employing low surface energy materials on the fuser roll surface such as Teflon® and the like or employing release fluids such as silicone oils.

Specific embodiments of the invention will now be described in detail. These examples are intended to be illustrative, and the invention is not limited to the materials, conditions, or process parameters set forth in these embodiments.

EXAMPLE I

An electret was formed by preparing a glass slide with a coating of poly(p-xylylene) (commercially available as Parylene-N from Union Carbide Corp.) about one micron thick and exposing the coated slide for 15 seconds to a plasma of sulfurhexafluoride gas at 50 microns Hg pressure formed with 25 watts of power. The resulting film was negatively charged and repelled drops of dodecane, α-methyl napthalene and tri-tolyl phosphate that had been negatively charged by inserting a probe needle connected to a power source into each droplet. Repulsion between the drops and the film was evidenced by a decreased area of contact between the droplets and the poly(p-xylylene) surface as compared to the area of contact between droplets of these materials and the poly(p-xylylene) surface prior to exposure to the plasma.

EXAMPLE II

Example I was repeated 5 times, exposing coated glass slides to the plasma for 30 seconds, 1 minute, 2 minutes, 4 minutes, and 8 minutes, respectively. The resulting films repelled charged drops of dodecane, α-methyl napthalene and tri-tolyl phosphate, as evidenced by a decreased area of contact between the droplets and the poly(p-xylylene) surface as compared to the area of contact between droplets of these materials and the poly(p-xylylene) surface prior to exposure to the plasma. The strength of the repulsion increased with increasing exposure to the highly charged plasma, as evidenced by decreasing area of contact between the droplets and the surface.

EXAMPLE III

The process of Example I was repeated with the exception that the coated slide was exposed for 1 minute to a plasma of 1 percent fluorine gas in helium. The resulting film was negatively charged and repelled negatively charged drops of dodecane, α-methyl napthalene and tri-tolyl phosphate, as evidenced by a decreased area of contact between the droplets and the poly(p-xylylene) surface as compared to the area of contact between droplets of these materials and the poly(p-xylylene) surface prior to exposure to the plasma.

EXAMPLE IV

The process of Example I was repeated with the exception that the coated slide was exposed for 8 minutes to a plasma of 5 percent fluorine gas in helium. The resulting film was negatively charged and repelled negatively charged drops of dodecane, α-methyl napthalene and tri-tolyl phosphate, as evidenced by a decreased area of contact between the droplets and the poly(p-xylylene) surface as compared to the area of contact between droplets of these materials and the poly(p-xylylene) surface prior to exposure to the plasma.

EXAMPLE V

The process of Example I was repeated 5 times with the exception that the coated slides were exposed for 30 seconds, 1 minute, 2 minutes, 4 minutes, and 8 minutes, respectively, to a plasma of 1 percent fluorine gas in argon. The resulting films repelled charged drops of dodecane, α-methyl napthalene and tri-tolyl phosphate, as evidenced by a decreased area of contact between the droplets and the poly(p-xylylene) surface as compared to the area of contact between droplets of these materials and the poly(p-xylylene) surface prior to exposure to the plasma. The strength of the repulsion increased with increasing exposure to the highly charged plasma, as evidenced by decreasing area of contact between the droplets and the surface.

EXAMPLE VI

Electrets were formed by preparing glass slides, each with a coating of polystyrene about one micron thick, and exposing the coated slides to a plasma of sulfurhexafluoride gas at 50 microns Hg pressure formed with 25 watts of power for 1 minute, 2.5 minutes, 5 minutes, 10 minutes, 20 minutes, and 40 minutes, respectively. The resulting films repelled charged drops of dodecane, α-methyl napthalene and tri-tolyl phosphate, as evidenced by a decreased area of contact between the droplets and the polystyrene surface as compared to the area of contact between droplets of these materials and the polystyrene surface prior to exposure to the plasma. The strength of the repulsion increased with increasing exposure to the highly charged plasma, as evidenced by decreasing area of contact between the droplets and the surface.

EXAMPLE VII

The procedures of Example VI were repeated with the exception that the coated glass slides were exposed to a plasma of 5 percent fluorine gas in helium. The resulting films repelled charged drops of dodecane, α-methyl naphthalene and tri-tolyl phosphate, as evidenced by a decreased area of contact between the droplets and the polystyrene surface as compared to the area of contact between droplets of these materials and the polystyrene surface prior to exposure to the plasma. The strength of the repulsion increased with increasing exposure to the highly charged plasma, as evidenced by decreasing area of contact between the droplets and the surface.

EXAMPLE VIII

The procedures of Example VI were repeated with the exception that the coated glass slides were exposed to a plasma of tetrafluoromethane gas. The resulting films repelled charged drops of dodecane, α-methyl napthalene and tri-tolyl phosphate, as evidenced by a decreased area of contact between the droplets and the polystyrene surface as compared to the area of contact between droplets of these materials and the polystyrene surface prior to exposure of the plasma. The strength of the repulsion increased with increasing exposure to the highly charged plasma, as evidenced by decreasing area of contact between the droplets and the surface.

EXAMPLE IX

Electrets were formed by preparing glass slides, each with a coating of polyisobutylene about one micron thick, and exposing the coated slides to a plasma of sulfurhexafluoride gas at 50 microns Hg pressure formed with 25 watts of power for 1 minute, 2.5 minutes, 5 minutes, 10 minutes, 20 minutes, and 40 minutes, respectively. The resulting films repelled charged drops of dodecane, α-methyl napthalene and tri-tolyl phosphate, as evidenced by a decreased area of contact between the droplets and the polyisobutylene surface as compared to the area of contact between droplets of these materials and the polyisobutylene surface prior to exposure to the plasma. The strength of the repulsion increased with increasing exposure to the highly charged plasma, as evidenced by decreasing area of contact between the droplets and the surface.

EXAMPLE X

The procedures of Example IX were repeated with the exception that the coated glass slides were exposed to a plasma of 5 percent fluorine gas in helium. The resulting films repelled charged drops of dodecane, α-methyl napthalene and tri-tolyl phosphate, as evidenced by a decreased area of contact between the droplets and the polyisobutylene surface as compared to the area of contact between droplets of these materials and the polyisobutylene surface prior to exposure to the plasma. The strength of the repulsion increased with increasing exposure to the highly charged plasma, as evidenced by decreasing area of contact between the droplets and the surface.

EXAMPLE XI

The procedures of Example IX were repeated with the exception that the coated glass slides were exposed to a plasma of tetrafluoromethane gas. The resulting films repelled charged drops of dodecane, α-methyl napthalene and tri-tolyl phosphate, as evidenced by a decreased area of contact between the droplets and the polyisobutylene surface as compared to the area of contact between droplets of these materials and the polyisobutylene surface prior to exposure to the plasma. The strength of the repulsion increased with increasing exposure to the highly charged plasma, as evidenced by decreasing area of contact between the droplets and the surface.

EXAMPLE XII

Electrets were formed by preparing glass slides, each with a coating of polybutadiene about one micron thick, and exposing the coated slides to a plasma of sulfurhexafluoride gas at 50 microns Hg pressure formed with 25 watts of power for 20 minutes and 40 minutes, respectively. The resulting films repelled charged drops of dodecane, α-methyl napthalene and tri-tolyl phosphate, as evidenced by a decreased area of contact between the droplets and the polybutadiene surface as compared to the area of contact between droplets of these materials and the polybutadiene surface prior to exposure to the plasma. The strength of the repulsion increased with increasing exposure to the highly charged plasma, as evidenced by decreasing area of contact between the droplets and the surface.

EXAMPLE XIII

The procedures of Example XII were repeated with the exception that the coated glass slides were exposed to a plasma of 5 percent fluorine gas in helium. The resulting films repelled charged drops of dodecane, α-methyl napthalene and tri-tolyl phosphate, as evidenced by a decreased area of contact between the droplets and the polybutadiene surface as compared to the area of contact between droplets of these materials and the polybutadiene surface prior to exposure to the plasma. The strength of the repulsion increased with increasing exposure to the highly charged plasma, as evidenced by decreasing area of contact between the droplets and the surface.

EXAMPLE XIV

The procedures of Example XII were repeated with the exception that the coated glass slides were exposed to a plasma of tetrafluoromethane gas. The resulting films repelled charged drops of dodecane, α-methyl napthalene and tri-tolyl phosphate, as evidenced by a decreased area of contact between the droplets and the polybutadiene surface as compared to the area of contact between droplets of these materials and the polybutadiene surface prior to exposure to the plasma. The strength of the repulsion increased with increasing exposure to the highly charged plasma, as evidenced by decreasing area of contact between the droplets and the surface.

EXAMPLE XV

Electrets were formed by preparing glass slides, each with a coating of polynorbornadiene about one micron thick, and exposing the coated slides to a plasma of sulfurhexafluoride gas at 50 microns Hg pressure formed with 25 watts of power for 20 minutes and 40 minutes, respectively. The resulting films repelled charged drops of dodecane, α-methyl napthalene and tri-tolyl phosphate, as evidenced by a decreased area of contact between the droplets and the polynorbornadiene surface as compared to the area of contact between droplets of these materials and the polynorbornadiene surface prior to exposure to the plasma. The strength of the repulsion increased with increasing exposure to the highly charged plasma, as evidenced by decreasing area of contact between the droplets and the surface.

EXAMPLE XVI

The procedures of Example XV were repeated with the exception that the coated glass slides were exposed to a plasma of 5 percent fluorine gas in helium. The resulting films repelled charged drops of dodecane, α-methyl napthalene and tri-tolyl phosphate, as evidenced by a decreased area of contact between the droplets and the polynorbornadiene surface as compared to the area of contact between droplets of these materials and the polynorbornadiene surface prior to exposure to the plasma. The strength of the repulsion increased with increasing exposure to the highly charged plasma, as evidenced by decreasing area of contact between the droplets and the surface.

EXAMPLE XVII

The procedures of Example XV were repeated with the exception that the coated glass slides were exposed to a plasma of tetrafluoromethane gas. The resulting films repelled charged drops of dodecane, α-methyl napthalene and tri-tolyl phosphate, as evidenced by a decreased area of contact between the droplets and the polynorbornadiene surface as compared to the area of contact between droplets of these materials and the polynorbornadiene surface prior to exposure to the plasma. The strength of the repulsion increased with increasing exposure to the highly charged plasma, as evidenced by decreasing area of contact between the droplets and the surface.

EXAMPLE XVIII

Fuser rolls are formed by coating three rollers comprising aluminum cores with Viton ®V, available from E. I. Du Pont de Nemours and Co., to a thickness of 20 mils and exposing the rollers to plasmas of sulfurhexafluoride, tetrafluoromethane, and 5 percent fluorine gas in helium, each at 50 microns Hg pressure, for 4 minutes at 25 watts of power. The rollers are then incorporated into electrophotographic imaging devices. Images are formed on a selenium drum photoreceptor and developed with a black developer comprising 3 parts by weight of a toner and 100 parts by weight of a carrier. The toner comprises 9 percent by weight of Regal 330® carbon black and 91 percent by weight of a styrene/n-butylmethacrylate copolymer in which styrene is present in an amount of about 58 percent by weight and n-butylmethacrylate is present in an amount of about 42 percent by weight. The carrier comprises a steel core coated with methyl terpolymer (methyl methacrylate, styrene, triorganosilane) at a coating weight of about 0.6 percent, as illustrated in U.S. Pat. No. 3,526,533, the disclosure of which is totally incorporated herein by reference. Subsequently, the developed images are transferred to paper substrates and permanently fused by heat and pressure applied with the fuser rolls prepared as described herein, resulting in a black and white image. It is believed that substantially no offset of the toner onto the fuser roll will be observed because of the repulsion between the negatively charged toner particles and the negatively charged electret on the surface of the fuser roll.

EXAMPLE XIX

A fuser roll is formed by coating a roller comprising a copper core with HTV silicone rubber to a thickness of 60 mils. The roller is incorporated into an electrophotographic imaging device and exposed to negative ions generated by a wire corotron, thereby charging the roll surface to a voltage of about −300 volts. Images are formed on a selenium drum photoreceptor and developed with a black developer comprising 3 parts by weight of a toner and 100 parts by weight of a carrier. The toner comprises 9 percent by weight of Regal 330® carbon black and 91 percent by weight of a styrene/n-butylmethacrylate copolymer in which styrene is present in an amount of about 58 percent by weight and n-butylmethacrylate is present in an amount of about 42 percent by weight. The carrier comprises a steel core coated with methyl terpolymer (methyl methacrylate, styrene, triorganosilane) at a coating weight of about 0.6 percent, as illustrated in U.S. Pat. No. 3,526,533, the disclosure of which is totally incorporated herein by reference. Subsequently, the developed images are transferred to paper substrates and permanently fused by heat and pressure applied with the fuser roll, resulting in a black and white image. It is believed that substantially no offset of the toner onto the fuser roll will be observed because of the repulsion between the negatively charged toner particles and the negatively charged surface of the fuser roll.

EXAMPLE XX

A fuser roll is formed by coating a roller comprising a steel core with Viton®V, available from E. I. Du Pont de Nemours and Co., to a thickness of 15 mils. The roller is incorporated into an electrophotographic imaging device and exposed to positive ions generated by a wire corotron, thereby charging the roll surface to a voltage of about +250 volts. Images are formed on a negatively charged layered organic photoreceptor as illustrated in U.S. Pat. No. 4,265,990, the disclosure of which is totally incorporated herein by reference, and developed with a black developer comprising 2.5 parts by weight of a toner and 100 parts by weight of a carrier. The positively charged toner comprises about 6 percent by weight of carbon black, about 2 percent by weight of a cetyl pyridinium chloride charge control agent, and about 92 percent by weight of a styrene-n-butylmethacrylate copolymer in which styrene is present in an amount of about 58 percent by weight and n-butylmethacrylate is present in an amount of about 42 percent by weight, as illustrated in U.S. Pat. No. 4,298,672, the disclosure of which is totally incorporated herein by reference. The carrier comprises an oxidized grit steel core powder coated to a coating weight of about 0.175 percent by weight with polyvinylidene fluoride, commercially available as Kynar®, as illustrated in U.S. Pat. No. 4,233,307, the disclosure of which is totally incorporated herein by reference. Subsequently, the developed images are transferred to paper substrates and permanently fused by heat and pressure applied with the fuser roll, resulting in a black and white image. It is believed that substantially no offset of the toner onto the fuser roll will be observed because of the repulsion between the positively charged toner particles and the positively charged surface of the fuser roll.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for fusing an electrophotographic image to a substrate which comprises developing an electrostatic latent image with a toner of one polarity and contacting the developed image with a fuser roll having on the surface thereof an insulating material which comprises a polymeric electret material having embedded therein stable electrical charges of the same polarity as that of the toner.

2. A process according to claim 1 wherein the fuser roll is heated by an internal heating means and the developed image is fused to the substrate by heat and pressure.

3. A process according to claim 1 wherein the developed image is fused to the substrate by pressure.

4. A process according to claim 1 wherein the surface of the fuser roll is periodically charged by activating a charging means.

5. A process according to claim 4 wherein the charging means is a corotron.

6. A process according to claim 4 wherein the fuser roll contains a resistive material dispersed in the insulating material and increases in temperature from room temperature to from about 325° F. to about 450° F. when the charging means is activated.

7. A process according to claim 6 wherein the resistive material is selected from the group consisting of conducting carbon black, tin oxides, zinc oxides, iron oxides, copper, copper oxides, and copper salts.

8. A process according to claim 1 wherein the fuser roll is cleaned by a cleaning means in contact therewith.

9. A process according to claim 8 wherein the cleaning means continuously cleans the fuser roll.

10. A process according to claim 8 wherein the cleaning means periodically cleans the fuser roll.

11. A process according to claim 1 wherein the polymeric material is selected from the group consisting of hexamethyldisiloxane, tetrafluoroethylene, HTV silicone rubber, RTV silicone rubber, polytetrafluoroethylenes, fluorocarbon elastomers, saturated hydrocarbon polymers, poly(arylenes) poly(ethylene terphthalates), poly(ether ether ketones), poly(carbonates), poly(carbonate-co-esters), poly(sulfones), poly(arylates), poly(etherimides), poly(arylsulfones), poly(ethersulfones), and poly(amide-imides).

12. A process according to claim 1 wherein the polymeric material is selected from the group consisting of a vinylidene fluoridebased fluoroelastomer containing hexafluoropropylene as a comonomer, poly(isobutylene), poly(ethylene), poly(propylene), polybutylene, polystyrene, polynorbornadien, and poly(p-xylylene).

13. A process according to claim 1 wherein the polymeric material is poly(p-xylylene).

14. A cylindrical fuser roll suitable for fusing to a substrate electrophotographic images which have been developed with a toner of one polarity and transferred to the substrate, which comprises a polymeric electret material having embedded therein stable electrical charges of the same polarity as that of the toner.

15. A fuser roll according to claim 14 wherein the polymeric material is selected from the group consisting of hexamethyldisiloxane, tetrafluoroethylene, HTV silicone rubber, RTV silicone rubber, polytetrafluoroethylenes, fluorocarbon elastomers, saturated hydrocarbon polymers, poly(arylenes) poly(ethylene terphthalates), poly(ether ether ketones), poly(carbonates), poly(carbonate-co-esters), poly(sulfones), poly(arylates), poly(etherimides), poly(arylsulfones), poly(ethersulfones), and poly(amide-imides).

16. A fuser roll according to claim 14 wherein the polymeric material is selected from the group consisting of a vinylidene fluoridebased fluoroelastomer containing hexafluoropropylene as a comonomer, poly(isobutylene), poly(ethylene), poly(propylene), polystyrene, polybutadiene, polynorbornadiene, and poly(p-xylylene).

17. A fuser roll according to claim 14 wherein the polymeric material is poly(p-xylylene).

18. A fuser roll according to claim 14 wherein the polymeric material is coated onto the surface of a core containing a resistive material, which core increases in temperature from room temperature to from about 325° F. to about 450° F. when the fuser roll is charged by corona discharge.

19. A fuser roll according to claim 18 wherein the resistive material is selected from the group consisting of conducting carbon black, tin oxides, zinc oxides, iron oxides, copper, copper oxides, and copper salts.

20. A process for fusing an electrophotographic image to a substrate which comprises developing an electrostatic latent image with a toner of one polarity and contacting the developed image with a fuser roll having on the surface thereof an insulating material charged to the same polarity as the toner, wherein the fuser roller is prepared by coating an insulating polymer onto a cylindrical core, placing the coated roller in a chamber containing a fluorinated gas, and applying a high voltage discharge within the chamber, thereby generating ions and free radicals that react with the polymer to form a polymer electret having electric charges stably embedded therein.

21. A process according to claim 20 wherein the insulating polymer is selected from the group consisting of hexamethyldisiloxane, tetrafluoroethylene, HTV silicone rubber, RTV silicone rubber, polytetrafluoroethylenes, fluorocarbon elastomers, saturated hydrocarbon polymers, poly(arylenes) poly(ethylene terphthalates), poly(ether ether ketones), poly(carbonates), poly(carbonate-co-esters), poly(sulfones), poly(arylates), poly(etherimides), poly(arylsulfones), poly(ethersulfones), and poly(amide-imides).

22. A process according to claim 20 wherein the polymeric material is selected from the group consisting of a vinylidene fluoridebased fluoroelastomer containing hexafluoropropylene as a comonomer, poly(isobutylene), poly(ethylene), poly(propylene), polystyrene, polybutadiene, polynorbornadiene, and poly(p-xylylene).

23. A process according to claim 20 wherein the polymeric material is poly(p-xylylene).

24. A process according to claim 20 wherein the fluorinated gas is selected from the group consisting of sulfurhexafluoride, fluorinated hydrocarbons, and fluorine gas.

25. A process according to claim 20 wherein the fluorinated gas is sulfurhexafluoride.

* * * * *